United States Patent [19]

Sato

[11] Patent Number: 4,733,698

[45] Date of Patent: Mar. 29, 1988

[54] HEAT TRANSFER PIPE

[75] Inventor: Yoshiyuki Sato, Isehara, Japan

[73] Assignee: Kabushiki Kaisha Kobe Seiko Sho, Kobe, Japan

[21] Appl. No.: 905,188

[22] Filed: Sep. 9, 1986

[30] Foreign Application Priority Data

Sep. 13, 1985 [JP] Japan ..... 60-203678
Sep. 13, 1985 [JP] Japan ..... 60-203679

[51] Int. Cl.[4] ..... F28F 1/40

[52] U.S. Cl. ..... 138/38; 165/177; 165/179

[58] Field of Search ..... 138/37, 38; 165/109.1, 165/177, 179, 181, 182, 183, 184

[56] References Cited

U.S. PATENT DOCUMENTS

| | | | |
|---|---|---|---|
| 2,279,548 | 4/1942 | Bailey | 138/38 X |
| 3,402,767 | 9/1968 | Bohdonsky et al. | 138/38 X |
| 3,750,709 | 8/1973 | French | 138/38 |
| 3,885,622 | 5/1975 | Mclain | 137/38 X |
| 4,690,211 | 9/1987 | Kuwahara et al. | 138/38 |

*Primary Examiner*—James E. Bryant, III

*Attorney, Agent, or Firm*—Oblon, Fisher, Spivak, McClelland & Maier

[57] ABSTRACT

A heat transfer pipe having in an inner surface thereof a plurality of first internal grooves formed in parallel with each other and having a generally rectangular cross sectional shape, and a plurality of second internal grooves formed in parallel with each other and crossing the first internal grooves, the second internal grooves having a cross section which is generally in the shape of an inverted trapezoid, the heat transfer pipe further having the following portions defined by the above first and second internal grooves; tunnel portions formed in the portions where the first internal grooves cross the second internal grooves, the tunnel portions each having a space; discontinuous projecting portions formed at the portions crossing the portions between the first internal grooves, the discontinuous projecting portions being parallel to the second internal grooves and each having a generally triangular cross section; and including opening portions of the first internal grooves formed in the intermittent portions of the projecting portions.

1 Claim, 12 Drawing Figures

HEAT TRANSFER PIPE

BACKGROUND OF THE INVENTION

1. Field of the Invention

The present invention relates to a heat transfer pipe for use in freezing, air conditioning, etc. as well as a method of making the same.

2. Description of the Prior Art

Heretofore, as heat transfer pipes for use in heat pump air conditioners or the like, there have mainly been used internally grooved pipes from the standpoint of attaining a high efficiency and saving energy. In such internally grooved pipes, fine triangular or trapezoidal grooves are formed straight or spirally in the inner surfaces of the pipes, as shown in Japanese Patent Laid Open No. 37059/79 and U.S. Pat. Nos. 4,044,797 and 4,373,366. Particularly, in a spirally grooved pipe, there is attained a superior boiling heat transfer characteristic because a corner portion of the internal groove forms a boiling nucleus, in addition to an improvement in the stirring action for internal fluid and an increase in the heat transfer rate due to increase of the internal surface area. Further, there have been developed a crosswise grooved pipe having a superior heat transfer characteristic in terms of evaporation and boiling as well as a heat transfer pipe having an improved vaporization heat characteristic and having a tunnel-like cavity formed in the inner wall surface thereof.

In a heat pump air conditioner, however, when the temperature of the outside air falls in winter for example, it is impossible to attain a sufficient evaporation of refrigerant because an evaporator is provided outdoors, thus often resulting in lowering of the heating temperature. This is due to deterioration of the vaporization heat characteristic of the heat transfer pipe used in the evaporator and is conspicuous particularly when the temperature is low.

As measures to avoid such inconvenience, improvements have been made with respect to the number of groove threads, lead angle, crossing and shape in conventional internally grooved pipes. But since there is a limit in such improvements, it is impossible to expect improving the heat transfer characteristic without deterioration of the con-ensation characteristic.

Further, if a heat transfer pipe having the above tunnel-like cavity is used, the number of sharp projections decreases, so the condensation characteristic deteriorates.

An outdoor machine of the heat pump air conditioner functions as a condenser during the summer season, so the deterioration of the condensation characteristic causes deficiency in the cooling capacity during the summer season.

SUMMARY OF THE INVENTION

The present invention serves to overcome such conventional drawbacks, and it is the object thereof to provide a heat transfer pipe having an improved evaporation characteristic without deterioration of the condensation characteristic as compared with conventional internally grooved pipes, as well as a method of making same.

According to the gist of the heat transfer pipe which the present invention adopts for achieving the above-mentioned object, the heat transfer pipe is provided in an inner surface thereof with a plurality of first internal grooves formed in parallel with each other and having a generally rectangular cross sectional shape, and a plurality of second internal grooves formed in parallel with each other, crossing the first internal grooves and having a cross section which is generally in the shape of an inverted trapezoid, whereby there are defined, tunnel portions in the portions where the first internal grooves cross the second internal grooves, the tunnel portions each having spaced, discontinuous projecting portions at the portions crossing the portions between the first internal grooves, the discontinuous projecting portions being parallel to the second internal grooves and each having a generally triangular cross section, and including opening portions of the first internal grooves in the discontinuous portions of the projecting portions.

According to the gist of the method of the invention for producing such heat transfer pipe having crossed internal grooves formed in the pipe inner surface, first internal grooves of a generally rectangular cross section are formed in the pipe inner surface by means of a first grooved plug having a comb of teeth-shaped cross section, the first internal grooves having a depth which is at least 0.50 times, preferably at least 0.75 times, the width of the grooves, followed by the top flat surfaces of lands between the first internal grooves being pressed partially by means of a second grooved plug having a groove of a generally triangular cross section in a direction crossing the first internal grooves, thereby forming the root portions of the first internal grooves into tunnel portions having intermittent spaces and opening portions, and the top portions of the first internal grooves being formed into discontinuous projecting portions of a generally triangular cross section.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

For a better understanding of the present invention, an embodiment of the invention will be described hereinunder with reference to FIGS. 1 to 10. It is to be understood, however, that the following embodiment is a mere concrete example of the invention and is not intended to limit the technical scope of the invention.

Figure 1:
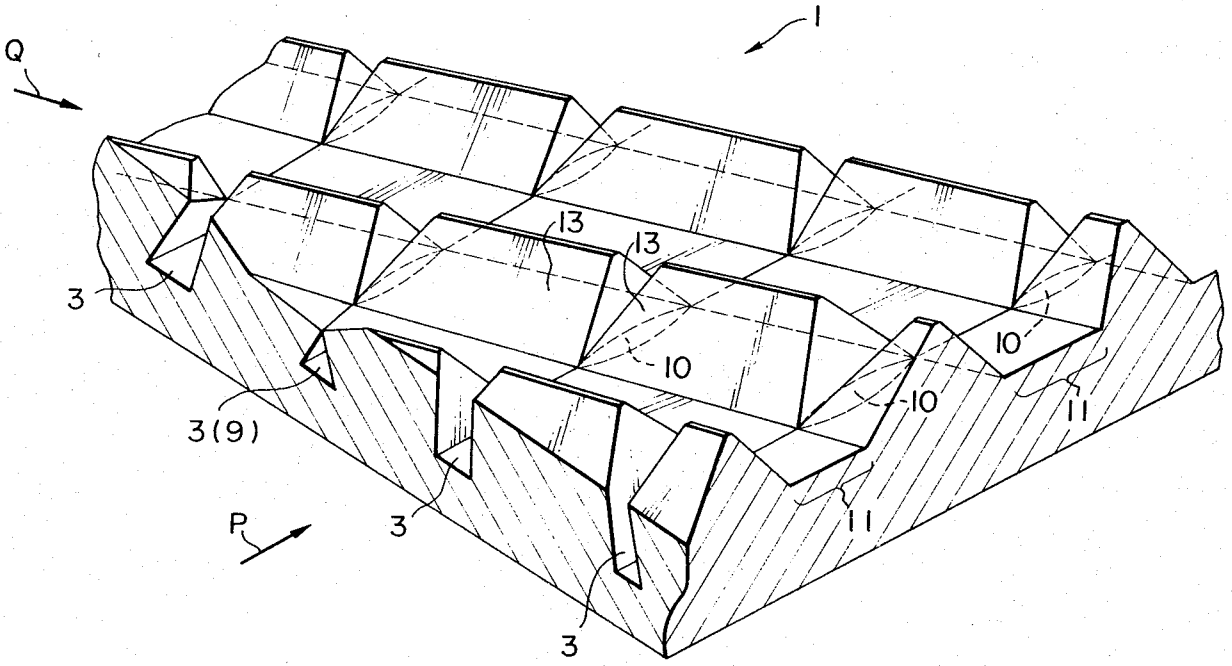
FIG. 1 is a perspective view of a heat transfer pipe formed by a manufacturing method according to an embodiment of the present invention, with an inner surface of the pipe being developed in a plane.

An inner surface of an internal crosswise grooved pipe 1 produced by the manufacturing method of the present invention is constructed as shown in FIG. 1, in which first internal grooves are formed in the direction of arrow P, while second internal grooves are formed in the direction of arrow Q.

Figure 2:
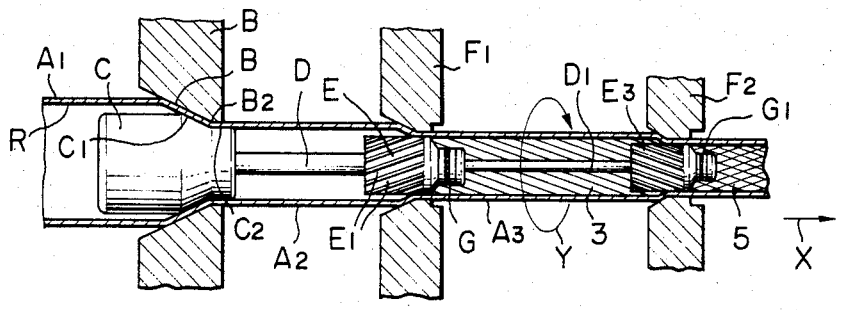
FIG. 2 is a side view showing an example of an apparatus for producing the heat transfer pipe.
Figure 3:
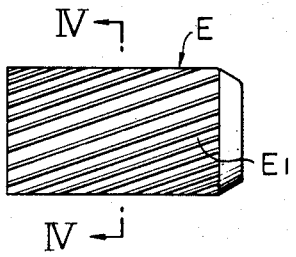
FIG. 3 is a schematic side view of a first grooved plug.
Figure 4:
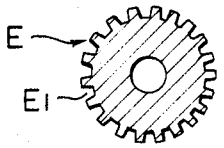
FIG. 4 is a sectional view taken along line IV—IV of FIG. 3.

In FIG. 2, an original pipe $A_1$ is pulled in the direction of arrow X by means of a pulling device (not shown). Tapered approach portions $B_1$, $C_1$ and bearing portions $B_2$, $C_2$ of a circular die B and an intrapipe floating plug C cooperate with each other to press the continuously passing original pipe $A_1$ from both the inside and outside, thereby reducing the diameter and wall thickness of the pipe. In this case, in order to diminish the frictional force at the portion of the circular die B, the die B may be a rotary type die, or may be even a fixed type, depending on the material of the pipe $A_1$. Between the floating plug C and the inner surface of the pipe there is provided a thin lubricating oil film to allow it to act effectively for preventing seizing during the diameter and wall thickness reducing operation. The lubricating oil film is formed by thinly spreading a lubricant R beforehand within the original pipe $A_1$.

To a rear side (downstream side in the pipe drawing direction) of the floating plug C there is connected, through a connecting rod D, a first grooved plug E for grooving the pipe inner surface, rotatably and independently of the floating plug C. The inner surface of a pipe $A_2$ after reduction of the diameter is a curved surface (FIG. 5), and with passing of the pipe $A_2$, a pulling force in the direction of the pipe axis acts on the rear portion of the first grooved plug E, but a thrust bearing G for supporting such axial pulling force is attached to the rear portion of the first groove plug E, so the first grooved plug E can rotate in a predetermined position.

A plurality of grooves $E_1$ having a regularly or irregularly (randomly) arranged comb teeth-like cross sectional shape are formed in an outer surface of the first grooved plug E in a generally obliquely inclined form relative to the pipe axis. The wall of the passing pipe $A_2$ is embedded in the recesses of the grooves $E_1$ by pressing from the pipe exterior to form land portions of first internal grooves 3 (FIG. 5) of the internally grooved pipe, while the convex portions of the grooves E form root portions of the first internal grooves 3.

Where the grooves $E_1$ formed in the outer surface of the first grooved plug E are straight relative to the pipe axis (that is, parallel to the pipe axis), there are formed straight grooves in the pipe inner surfaces as the pipe is drawn out, and the first grooved plug E never rotates upon movement of the pipe.

A first rolling device $F_1$ located outside the pipe for pressing the pipe wall continuously against the first grooved plug E is pushed against the pipe by means of a contacting/separating mechanism (not shown) during processing, while during non-processing it is kept spaced away from the pipe outer surface by the same mechanism. The first rolling device $F_1$ is provided three or more around the outer peripheral surface of the pipe so that they press the pipe wall simultaneously through the contacting/separating mechanism.

Figure 5:
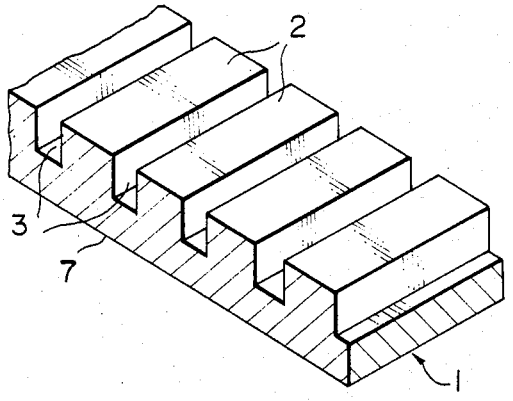
FIG. 5 is a perspective view showing an intermediate state in the manufacturing process for the heat transfer pipe shown in FIG. 1.

In the above internally grooving apparatus, when the first rolling device $F_1$ and the circular die B are rotated as indicated by arrow Y while a pipe $A_3$ is pulled in the direction of arrow X, first the original pipe $A_1$ is reduced in diameter while being held between the approach portion $C_1$ of the floating plug C and the approach portion $B_1$ of the circular die B, and the pipe outside diameter is restricted when the pipe passes between the bearing portion $B_2$ of the circular die B and the bearing portion $C_2$ of the floating plug C, then the pipe is drawn out as the reduced-diameter pipe $A_2$. The pipe $A_2$ is pushed against the grooves $E_1$ of the first grooved plug E by means of the first rolling device $F_1$, so that the first internal grooves 3 are formed in the inner surface of the pipe spirally in conformity with the angle of inclination of the grooves $E_1$. The shape of the first internal grooves 3 is as shown in FIG. 5.

Figure 6:
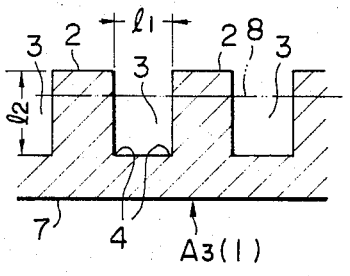
FIG. 6 is a cross sectional view, with first internal grooves developed in a plane.

As shown in FIG. 6 which illustrates, in a planewise developed and enlarged state, the first internal grooves 3 formed in the inner surface of the pipe $A_3$ after passing through the first rolling device $F_1$, the depth $l_2$ of the first internal grooves 3 is set larger than the width $l_1$. The actual shape of the first internal grooves 3 is not always such a mathematical rectangular shape as shown in FIG. 6. Corner portions may be slightly rounded or collapsed, and in many cases bottom corners 4 may be rounded.

The pipe $A_3$ having the first internal grooves 3 thus formed in the inner surface thereof then passes through a second rolling device $F_2$. A second grooved plug $E_3$ is disposed within the pipe $A_3$ in a position corresponding to the second rolling device $F_2$. By this second grooved plug $E_3$ there are formed second internal grooves in the direction of arrow Q which cross the first internal grooves extending in the direction of arrow Q which cross the first internal grooves extending in the direction of arrow P as shown in FIG. 1.

Figure 7:
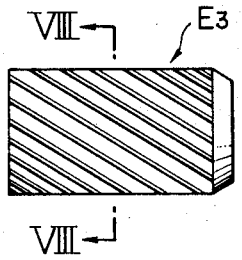
FIG. 7 is a schematic side view of a second grooved plug.
Figure 8:
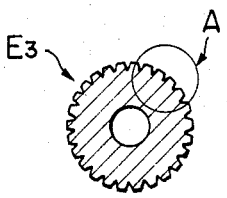
FIG. 8 is a sectional view taken along line VIII—VIII of FIG. 7.
Figure 9:
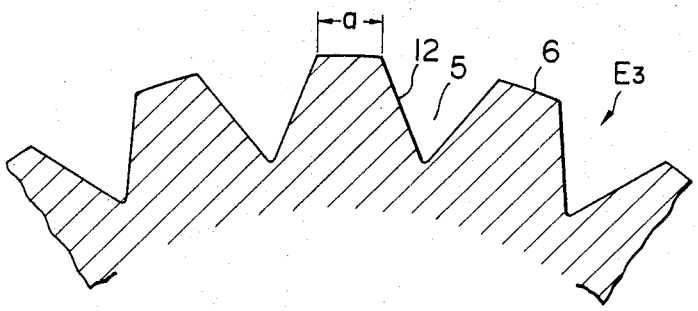
FIG. 9 is a detail view of portion A of FIG. 8.

As shown in FIGS. 7 to 9, the second grooved plug $E_3$ has grooves 5 of a generally rectangular cross section and outer peripheral surface portions 6, formed alternately and spirally on the outer peripheral surface of the plug.

Consequently, in the second rolling device $F_2$, the top flat faces of land portions between the first internal grooves are passed toward a pipe outer surface 7 (FIG. 6) by the outer peripheral surface portions 6 of the second grooved plug $E_3$. Thus, as a result of secondary processing by the second grooved plug $E_3$, a pipe inner surface 2 is pressed toward the pipe outer surface 7 and the land top flat faces of the thus-pressed portions come to have a height indicated by alternate long and two short dashed lines 8 in FIG. 6.

Figure 10:
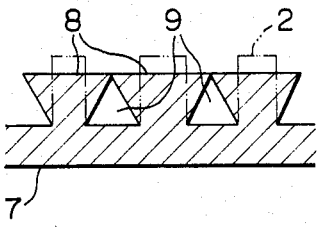
FIG. 10 is a sectional view of tunnel portions formed on the first internal grooves.

When the land top flat faces are thus pressed, the land top flat faces of the first internal grooves 3 indicated by alternate long and two short dashed lines in FIG. 10 are expanded outwardly of the lands (namely in the root direction of the first internal grooves) as indicated by solid lines to form tunnel portions 9 of a generally rectangular section, while leaving spaces, in the overhanging portions of adjacent lands. The actual shape of such tunnel portions is not always such a triangular shape as shown in FIG. 10, but may be of a collapsed shape.

In this case, if the depth $l_2$ (FIG. 6) of the first internal grooves 3 is too small as compared with the width $l_1$ thereof, then even when the land top portions overhang, the overhanging portions come into close contact with the bottoms of the grooves 3, so the tunnel portions 9 are not formed. For forming the tunnel portions 9, the $l_2/l_1$ ratio must be at least 0.50, preferably not smaller than 0.75, and $l_2/l_1 > 1$ is desirable for facilitating the secondary processing with the second grooved plug $E_3$. If $l_2$ is too small or if the width of second internal grooves 11 is too small, the tunnel portions 9 become smaller and thus it is impossible to maintain blow holes.

Further, by the outer peripheral surface portions 6 of the second grooved plug $E_3$ there are formed bottom faces of the second internal grooves 11, namely, top faces of the tunnel portions 9 shown in FIG. 10. In this case, if the length "a" (FIG. 9) of the outer peripheral surface portions 6 is small, the length of the the tunnel portions 9 becomes smaller and the effect of tunnel becomes insufficient.

In this manner, the land portions of the first internal grooves 3 pressed by the outer peripheral surface portions 6 of the second grooved plug $E_3$ are formed as the second internal grooves 11 as shown in FIG. 1. Portions (i.e., unpressed portions) between the pressed portions are pushed out by slant faces 12 of the grooves 5 of the second grooved plug $E_3$ and so protrude to form projecting portions 13 of a generally triangular cross section intermittently as shown in FIG. 1. Intermittent connections of the projecting portions 13 serve as opening portions 10 in which the first internal grooves 3 are open to the pipe interior. Actually, the opening portions 10 are formed so that the surface of the second internal grooves 11 of the opening portions 10 are expanded.

The second grooved plug $E_3$ is supported rotatably by a connecting rod $D_1$ provided on an extension of the connecting rod D and is held in a predetermined axial position by a thrust bearing $G_1$.

In the above description the first internal grooves 3 are formed in the left-hand thread direction and the second internal grooves 11 in the right-hand thread direction, but by suitably adjusting the direction of the grooves $E_1$ and 5 formed in the grooved plugs, either the first or the second internal grooves may be formed straight, that is, parallel to the pipe axis, while the other may be formed spirally in the cross right- or left-hand thread direction.

Further, although in the above apparatus and method the floating plug C and the first and second grooved plugs E and $E_3$ are connected in a unitary form through the connecting rods D and $D_1$ to thereby form the first and second internal grooves 3 and 11 continuously, there may be adopted a construction in which those plugs are separated, for example, the floating plug C and the first grooved plug E being combined integrally through a connecting rod to thereby form the first internal grooves 3, and after a continuous winding, the second internal grooves 11 being formed on the first internal grooves 3 by using a combination of the second grooved plug $E_3$ with another floating plug, thus forming the internal grooves 3 and 11 and the tunnel portions 9 batchwise.

In any event, by the crossing of the first and second internal grooves 3 and 11 there are formed the tunnel portions 9 only at the crossed portions, while at the non-crossed portions there are formed the opening portions 10 in which the first internal grooves 3 are open toward the inner space of the pipe, and thus open and closed portions appear alternately along the first internal grooves 3.

In the heat transfer pipe having such an internal structure, the slight space in each tunnel portion 9 serves as the nucleus of boiling, thereby accelerating the boiling and evaporation of refrigerant liquid. In the tunnel portion 9 there remains a portion of boiled refrigerant gas, while the remaining portion escapes to the inner space of the heat transfer pipe 1 through the opening portions 10 between the tunnel portions 9 adjacent each other in the direction of arrow P. On the other hand, with the refrigerant gas remaining in the tunnel portions 9 as the nucleus, the refrigerant liquid evaporates and bubbles grow. In this way, with the inner spaces of the tunnel portions 9 as the starting point, there occurs active boiling and evaporation of the refrigerant liquid.

The projecting portions 13 have a sharp edge, and the condensate film is extremely thin in the vicinity of the sharp edge. Consequently, the heat resistance of the liquid film becomes small and the condensation heat transfer rate becomes larger, such that the condensation characteristic is improved as compared with conventional internally grooved pipes.

Concrete numerical values in this embodiment are as shown in Table 1. In order to confirm the effect of the heat transfer pipe of the present invention, there was conducted a test of comparison with a conventional internally grooved pipe having such numerical values as also set out in the same Table. (Both were of the same wall thickness as the original pipes used.)

Figure 11:
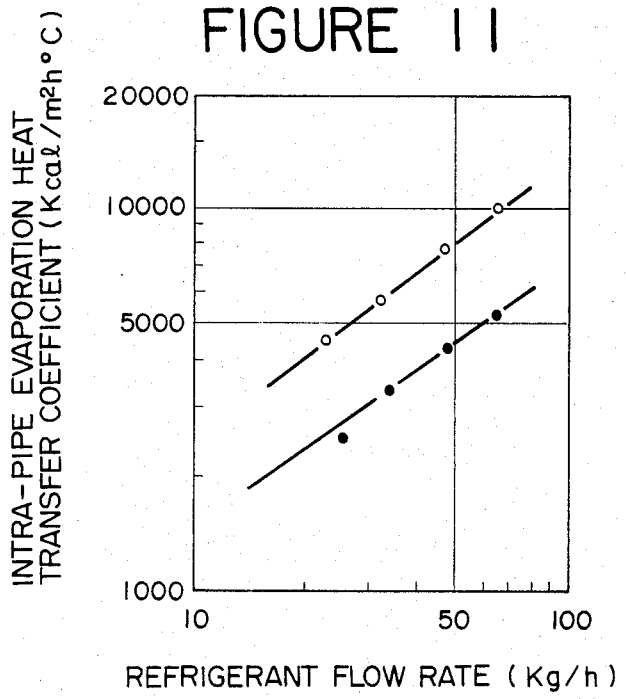
FIGS. 11 and 12 are test results.
Figure 12:
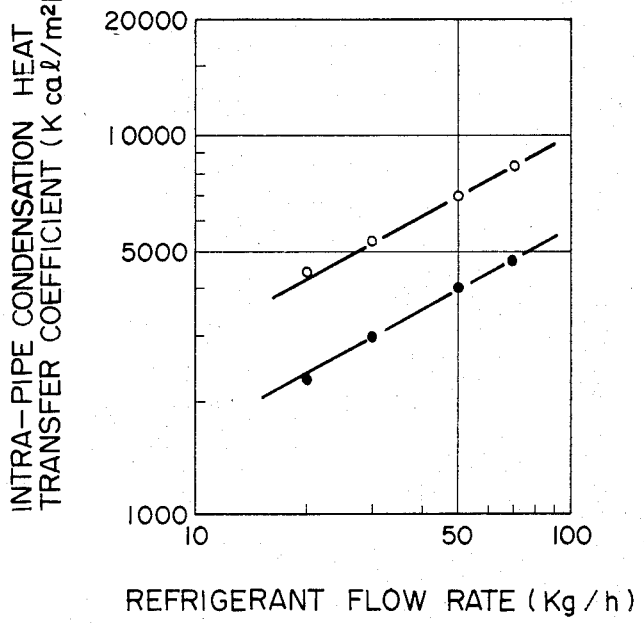

Results of the test are as shown in FIGS. 11 and 12. The heat transfer pipe of this embodiment was improved by a factor of about 1.9 times in terms of evaporation characteristic and about 1.8 times in terms of condensation characteristic as compared with the conventional internally grooved pipe.

TABLE 1

| | Heat Transfer Pipe of this Embodiment | | |
|---|---|---|---|
| | First Internal Grooves | Second Internal Grooves | Conventional Internally Grooved Pipe |
| Number of Grooves | 50 | 40 | 65 |
| Angle of Torsion | 25° (left-hand) | 25° (right-hand) | 25° |
| Depth of Groove (mm) | 0.3 | 0.22 | 0.15 |
| Outside Diameter of Pipe (mm) | 9.52 | | 9.52 |

As set forth hereinabove, the heat transfer pipe of the present invention is provided in an inner surface thereof with a plurality of first internal grooves formed in parallel with each other and having a generally rectangular cross sectional shape, and a plurality of second internal grooves formed in parallel with each other, crossing the first internal grooves and having a cross section which is generally in the shape of an inverted trapezoid, whereby there are defined, tunnel portions in the portions where the first internal grooves cross the second internal grooves, the tunnel portions each having a spaced, discontinuous projecting portions at the portions crossing the portions between the first internal grooves, the discontinuous projecting portions being parallel to the second internal grooves and each having a generally triangular cross section, and including opening portions of the first internal grooves in the discontinuous portions of the projecting portions. Consequently, the boiling and evaporating characteristics are improved in the tunnel portions, while the condensation characteristic improved in the projecting portions, and thus the heat transfer pipe is superior in both such characteristics. This is an outstanding effect.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heat transfer pipe having formed in an inner surface portion thereof:

a plurality of first internal grooves formed in parallel with each other and having a generally rectangular cross sectional shape; and a plurality of second internal grooves formed in parallel with each other and crossing said first internal grooves, said second internal grooves having a cross section which is generally in the shape of an inverted trapezoid;

and further comprising the following portions defined by said first and second internal grooves;

tunnel portions formed in portions where said first internal grooves cross said second internal grooves, said tunnel portions each having a space;

discontinuous projecting portions formed at portions crossing the portions between said first internal grooves, said discontinuous projecting portions being parallel to said second internal grooves and each having a generally triangular cross section; and opening portions of said first internal grooves formed in intermittent portions of said projecting portions.

* * * * *